US005202704A

United States Patent [19]

Iwao

[11] Patent Number: 5,202,704

[45] Date of Patent: Apr. 13, 1993

[54] TONER JET RECORDING APPARATUS HAVING MEANS FOR VIBRATING PARTICLE MODULATOR ELECTRODE MEMBER

[75] Inventor: Naoto Iwao, Nagoya, Japan

[73] Assignee: Brother Kogyo Kabushiki Kaisha, Aichi, Japan

[21] Appl. No.: 781,416

[22] Filed: Oct. 23, 1991

[30] Foreign Application Priority Data

Oct. 25, 1990 [JP] Japan ..... 2-288203
Oct. 25, 1990 [JP] Japan ..... 2-288204

[51] Int. Cl.[5] ..... B41J 2/415; B41J 2/005

[52] U.S. Cl. ..... 346/140 R; 346/159

[58] Field of Search ..... 346/140 R, 159; 355/261, 262, 265

[56] References Cited

U.S. PATENT DOCUMENTS 3,689,935 9/1972 Pressman et al. ..... 346/159
4,478,510 10/1984 Fujii et al. ..... 346/159
4,491,855 1/1985 Fujii et al. ..... 346/159
4,568,955 2/1986 Hosoya et al. ..... 346/159 X

FOREIGN PATENT DOCUMENTS 0410738 1/1991 European Pat. Off. .
0287568 11/1990 Japan .

*Primary Examiner*—Benjamin R. Fuller
*Assistant Examiner*—Alrick Bobb
*Attorney, Agent, or Firm*—Oliff & Berridge

[57] ABSTRACT

A toner jet recording apparatus having a particle-flow modulating electrode member having multiple apertures, a back electrode for supporting a recording medium interposed between the back electrode and the electrode member, and a control circuit for applying controlled electric signals to the electrode member and the back electrode, for causing flows of electrostatically charged toner particles through the selected apertures toward the back electrode. The apparatus is provided with an oscillating device for vibrating the electrode member, in a vibration mode in which an antinode is substantially aligned with a portion of the electrode member through which the apertures are formed. The oscillating device prevents plugging of the apertures with the particles.

12 Claims, 5 Drawing Sheets

TONER JET RECORDING APPARATUS HAVING MEANS FOR VIBRATING PARTICLE MODULATOR ELECTRODE MEMBER

BACKGROUND OF THE INVENTION

1. Field of the Invention

The present invention relates generally to a toner jet recording apparatus in which particle flows are modulated, and more particularly to a technique for preventing apertures of a particle-flow modulating electrode member from being plugged with the toner particles.

2. Discussion of the Prior Art

An example of a toner jet recording apparatus is disclosed in U.S. Pat. No. 3,689,935 to G. L. Pressman et. al. This recording apparatus includes a toner supply, a back electrode, and a particle-flow modulating electrode member disposed between the toner supply and the back electrode. A recording medium is passed between the modulating electrode member and the back electrode. The toner supply delivers a crowd of electrostatically charged toner particles, so that the crowd of the charged particles remains near the modulating electrode member. With controlled electric signals being applied to the back electrode and modulating electrode member, flows of the particles through multiple apertures of the modulating electrode member are selectively modulated. More specifically, the modulating electrode member consists of an insulating layer, a first electrode in the form of a conductive layer provided on one side of the insulating layer, and second electrodes in the form of an array of conductive strips provided on the other side of the insulating layer. The modulating electrode member has a multiplicity of apertures formed through the insulating layer and the first electrode layer and through the respective conductive strips of the second electrode. The back electrode is disposed in opposed relation with the modulating electrode member, so as to back the recording medium such as a paper sheet, and also functions to attract the particle flows through the apertures to the surface of the recording medium. Thus, the toner jet recording apparatus is adapted to effect recording on the recording medium, by modulating the flows of the charged toner particle such that the particle flows pass through the selected apertures according to the controlled electric signals applied to the modulating electrode member.

However, the known toner jet recording apparatus as described above suffers from plugging or filling of the apertures of the modulating electrode member with the toner particles. If the desired recording density is 240 DPI (dots per inch), the maximum size of image dots is 100 μm, and the maximum inside diameter of each aperture of the modulating electrode member should be as small as 50 μm. On the other hand, the toner particles tend to be deposited on the surfaces of the modulating electrode member due to the effect of the image force. Under this condition, the apertures are likely to be plugged or filled with the toner particles during use of the recording apparatus, deteriorating the image forming stability or reliability of the apparatus.

SUMMARY OF THE INVENTION

Discussion of the Related Art

In view of the above drawback of the known toner jet recording apparatus, the assignee of the present application developed a toner jet recording apparatus as disclosed in the co-pending application, Ser. No. 07/680,728 filed Apr. 5, 1991, which uses an oscillating device for vibrating the particle-flow modulating electrode member (control electrode) so as to avoid the plugging of the apertures with the toner particles, by preventing the deposition of the particles on the modulating electrode member owing to vibration acceleration induced by the vibration, which overcomes the image force that causes the deposition of the particles.

However, a further study by the present applicant indicated that the mere application of vibration to the particle-flow modulating electrode member is insufficient for effectively preventing the toner particles from being deposited on the modulating electrode member.

It is therefore an object of the present invention to provide a toner jet recording apparatus which is free from the conventionally experienced plugging of the apertures of the particle-flow modulating electrode member with the toner particles, and which is capable of operating with high image recording stability and reliability.

A second object of the invention is to provide such a toner jet recording apparatus adapted to effectively vibrate the modulating electrode member for preventing the plugging of the apertures.

The above objects may be achieved according to the principle of the present invention, which provides a toner jet recording apparatus, comprising: (a) a toner supply for providing a crowd of electrostatically charged toner particles; (b) a particle-flow modulating electrode member including an aperture portion which has a multiplicity of apertures; (c) a back electrode disposed in opposed relation with a surface of the modulating electrode member which is remote from the toner supply, the backing electrode supporting a recording medium which is interposed between the back electrode and the modulating electrode member; (d) a control circuit for applying controlled electric signals to the modulating electrode member and the back electrode, for causing flows of the charged particles through selected ones of the apertures toward the back electrode; and (e) an oscillating device for vibrating the modulating electrode member, in a vibration mode wherein an antinode is substantially aligned with the aperture portion of the modulating electrode member.

In operation of the toner jet recording apparatus of the present invention constructed as described above, the oscillating device is activated to cause the particle-flow modulating electrode member to vibrate such that the aperture portion is substantially aligned with an antinode at which the amplitude of the vibration and the vibration acceleration are the greatest. This arrangement is therefore effective to easily prevent the toner particles from being deposited on the modulating electrode member by the effect of the image force, thereby avoiding the plugging of the apertures with the toner particles.

The oscillating device is preferably adapted to apply ultrasonic vibration to the modulating electrode member. It is desirable that the ultrasonic vibration has a resonance frequency not lower than about 20 kHz.

Generally, the particle-flow modulating electrode member has a considerably small thickness, and therefore the resonance of the vibration of the modulating electrode member caused by the oscillating device tends to be low. Namely, a decrease in the thickness of the modulating electrode member results in increasing the difficulty in giving sufficiently high vibration acceleration to the modulating electrode member, i.e., difficult in avoiding the deposition of the toner particles on the aperture portion of the modulating electrode member.

In view of the above, the oscillating device preferably includes an elastic member disposed on the modulating electrode member, so that the modulating electrode member is vibrated together with the elastic member by an oscillator fixed to the elastic member. In this case, the elastic member should have a thickness considerably larger than that of the modulating electrode member, preferably more than ten times that of the latter, so that the elastic member has a resonance frequency not lower than 20 kHz.

BRIEF DESCRIPTION OF THE DRAWINGS

The above and other objects, features and advantages of the present invention will become more apparent by reading the following detailed description of presently preferred embodiments of the invention, when considered in connection with the accompanying drawings, in which.

DETAILED DESCRIPTION OF THE PREFERRED EMBODIMENTS

Figure 1:
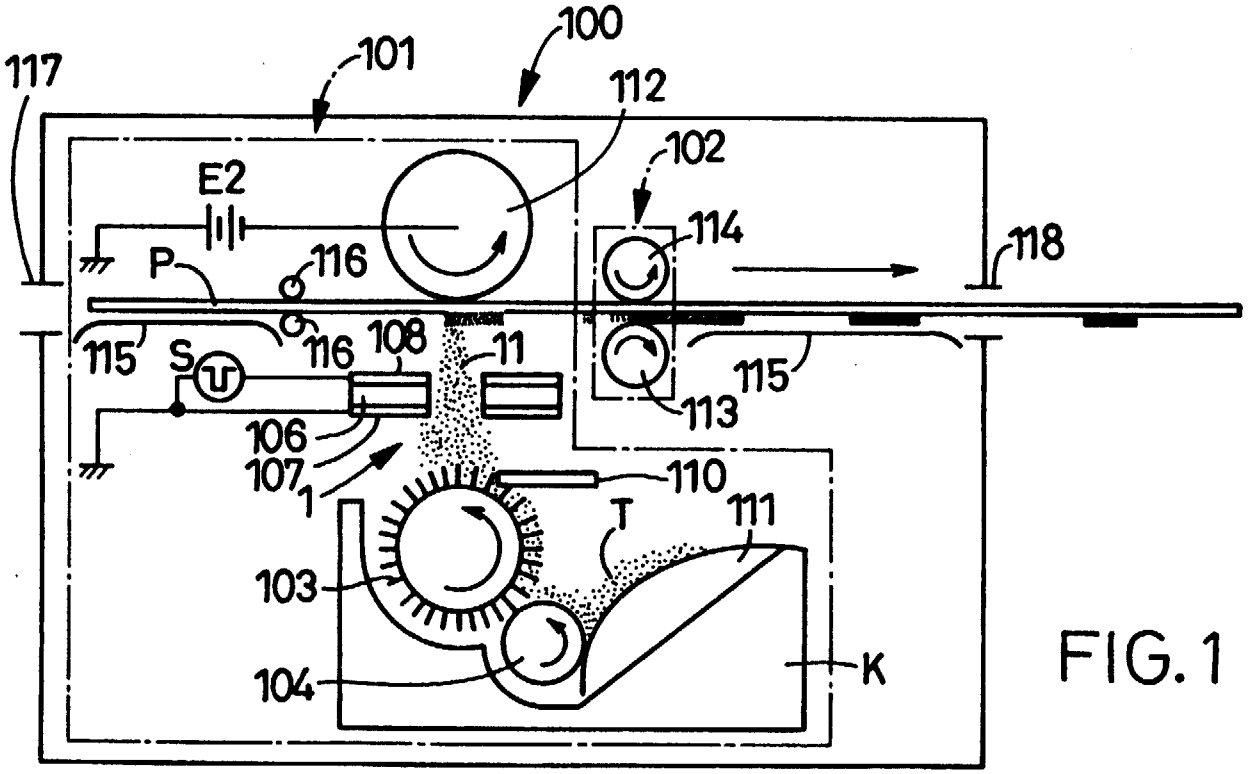
FIG. 1 is a schematic view of one embodiment of a toner jet recording apparatus of the present invention.

Referring first to FIG. 1, a toner jet recording apparatus is indicated generally at 100. The recording apparatus 100 includes a recording section 101, and thermal image fixing section 102 disposed downstream of the recording section 101 as viewed in a direction in which a recording medium P is fed through the apparatus 100 along a feed path. The feed path extends between an inlet 117 and an outlet 118, which are formed through opposite side walls of the apparatus 100. Printing is effected on the recording medium P such as a plain paper sheet, while the medium P entering the apparatus 100 through the inlet 117 is fed through the recording section 101. An image formed on the medium P is fixed on the surface of the medium by the thermal image fixing section 102. For feeding the medium P along the predetermined feed path, two guides 115 are disposed adjacent to the inlet 117 and the outlet 118, respectively.

The recording section 101 has a rotatable brush roller 103, a particle-flow modulating electrode member 1, and a backing roller 112. A toner supply roller 104 and a scratch member 110 are disposed in contact with a brush of the brush roller 103, such that the roller 104 and the scratch member 110 are spaced from each other in the circumferential direction of the brush roller 103. As shown in FIG. 1, the scratch member 110 is disposed downstream of the supply roller 104 in the rotating direction of the brush roller 103. The toner supply roller 104 is disposed in contact with a supply blade 111 on which a mass of toner particles T is stored. The supply blade 111 functions to supply the supply roller 104 with the toner particles T. The brush roller 103, supply roller 104 and supply blade 111 are accommodated within a toner casing K.

Figure 2:
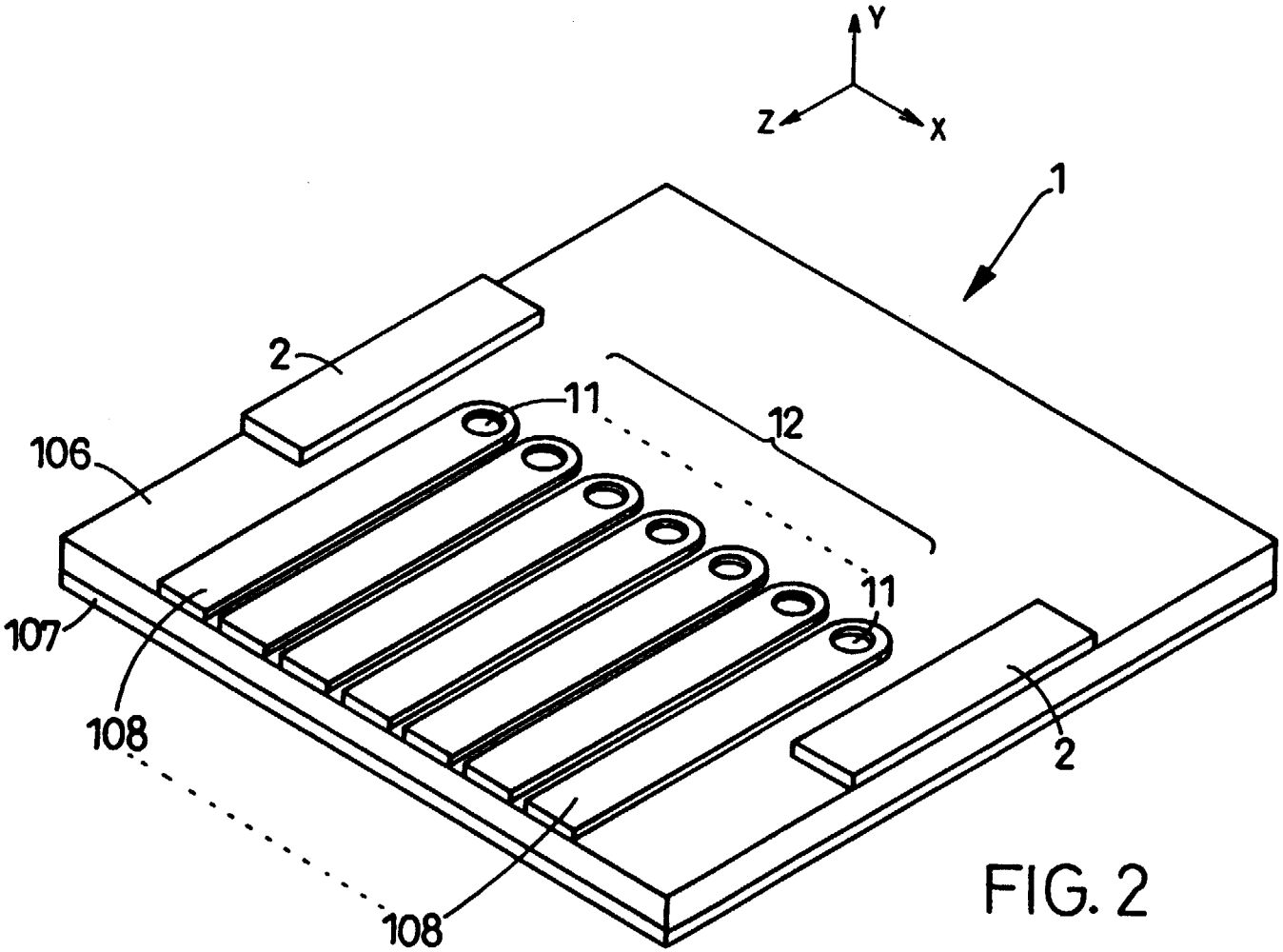
FIG. 2 is a perspective view showing a particle-flow modulating electrode member used in the apparatus of FIG. 1.
Figure 3:
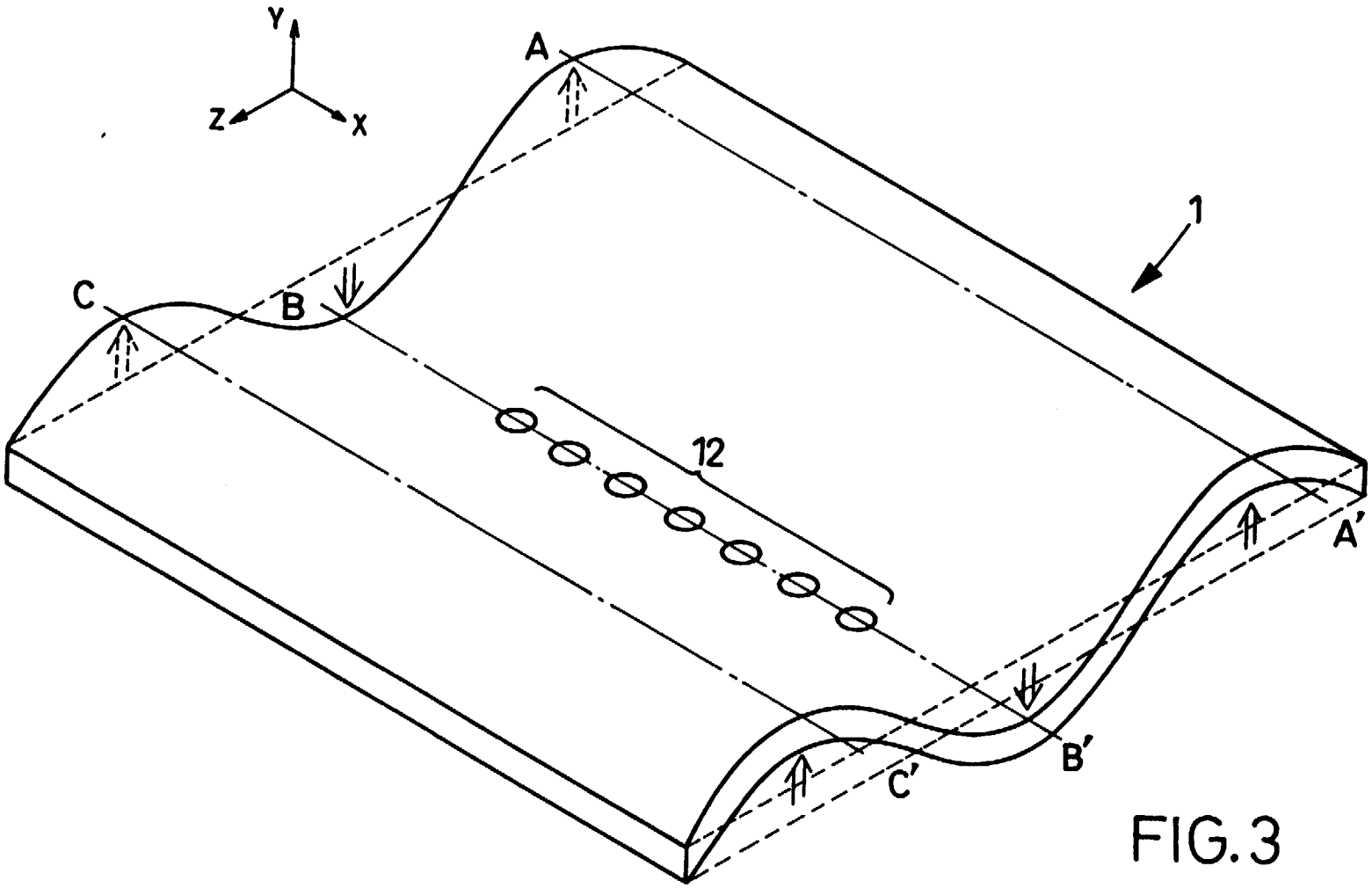
FIG. 3 is a perspective view indicating a bending vibration mode of the electrode member.

Referring further to FIG. 2, there will be described the particle-flow modulating electrode member 1, which is disposed above the brush roller 103. This electrode member 1 is a generally plate-like member having a rectangular shape, which includes an insulating layer 106, a reference electrode layer 107, and an array of control electrodes 108. On the insulating layer 106, there is provided an oscillating device in the form of two piezoelectric elements 2 as an oscillator. The reference electrode layer 107 is formed on one of the opposite major surfaces of the insulating layer 106 which is on the side of the brush roller 103, while the array of control electrodes 108 is formed on the other major surface of the insulating layer 106, such that the control electrodes take the form of elongate parallel strips which extends in a z-axis direction and are spaced apart from each other in an x-axis direction. The x-axis and z-axis directions define an x-z plane parallel to the plane of the insulating layer 106. The piezoelectric elements 2 are also elongate members which extending in the z-axis direction and are disposed at the opposite ends of the insulating layer 106 as viewed in the x-axis direction, such that the array of the control electrodes 108 are interposed between the two piezoelectric elements 2. The material, dimensions and shape of the electrode member 1 are selected or determined so that the electrode member 1 is capable of undergoing bending vibration at a predetermined frequency f(Hz) as indicated in FIG. 3.

The particle-flow modulating electrode member 1 has a multiplicity of apertures 11 formed in a straight row 12 in a middle portion thereof as viewed in the z-axis direction. The apertures 11 are formed through the insulating layer 106, reference electrode layer 107, and the end portions of the respective control electrodes 108. The reference electrode layer 107 is connected to the ground, while the control electrodes 108 are connected to respective signal sources indicated at S in FIG. 1. The piezoelectric elements 2 are bonded by an adhesive or otherwise secured by suitable means to the surface of the insulating layer 106 and are electrically connected to a driver circuit not shown, so that the elements 2 are activated so as to undergo elongation and contraction in the z-axis direction.

On one side of the electrode member 1 which is remote from the brush roller 103, there is disposed a back electrode 112 in the form of a roller, which cooperates with the electrode member 1 to define therebetween a space through which the recording medium P is fed along the feed path while being guided by the guide 115 adjacent to the inlet 117 and a pair of auxiliary rollers 116. The back electrode 112 is connected to a negative terminal of a power source E2. With a voltage applied to the back electrode 112, streams of the toner particles T which have passed through the selected apertures 11 are attracted to or deposited on the surface of the medium P.

The thermal image fixing section 102 consists of a heat roller 113 and a press roller 114, between which the medium P is passed so that the toner particles T deposited on the medium P is fixed under heat and pressure.

Referring back to FIG. 1, an operation of the toner jet recording apparatus 100 will be described. The recording medium P which has entered the recording section 101 through the inlet 117 is passed through the space between the electrode member 1 and the back electrode 112. In the meantime, the toner particles T are conveyed from the supply blade 111 to the supply roller 104. A crowd of the particles T carried by the supply roller 104 is transferred to the brush roller 103. Due to the frictional contact of the particles T with the supply and brush rollers 103, 104, the particles T are positively electrostatically charged. With the brush of the brush roller 103 being flexed by the scratch member 110, the charged particles T carried by the brush are thrown away toward the electrode member 1 when the flexed brush return to their normal attitude, due to the resiliency of the brush.

While the recording medium P is fed and the brush roller 103 is rotated, selected potentials are applied from the signal sources S to the control electrodes 108, so that selected streams of the charged particles T are passed through the corresponding apertures 11 and projected toward the recording surface of the medium P. Thus, the toner particles T are modulated by the control electrodes 108.

In the meantime, an electric signal having the predetermined frequency f(Hz) is applied from the driver circuit (not shown) to the piezoelectric elements 2 of the electrode member 1, so that the electrode member 1 is subjected to bending vibration as indicated in FIG. 3. An effect of the bending vibration will be described in detail. Briefly, the charged particles T are not allowed to adhere, by image force, to the portions of the electrode member 1 adjacent to the aperture row 12, since the antinode of the bending vibration caused by the piezoelectric elements 2 is located at or near the aperture row 12, at which the vibration acceleration is maximum. This arrangement assures consistent modulation of the streams of the particles T by the control electrodes 108 depending upon to the signals from the signal sources S, which are controlled according to printing data. In other words, the streams of the positively charged particles T are passed through the appropriate apertures 11 which are selected according to the printing data.

The thus modulated positively charged streams of the toner particles T are attracted toward and deposited on the surface of the recording medium P, due to the effect of the back electrode 112 connected to the negative terminal of the power source E2.

With the medium P passed through the thermal image fixing section 102, an image in the form of the toner particles T is fixed under heat by the heat roller 113 and pressure by the press roller 114. Since this manner of fixing of the image is well known in the art, detailed explanation thereof may be dispensed with. The medium P carrying the fixed image is ejected from the apparatus 100 through the outlet 118, while being guided by the guide 115 disposed between the fixing section 102 and the outlet 118.

Referring to FIGS. 2 and 3, there will be described the effect of the bending vibration of the electrode member 1 by the oscillating device in the form of the two piezoelectric elements 2.

During a recording operation, the electric signal having the predetermined frequency f(kHz) is applied to the piezoelectric elements 2, whereby the electrode member 1 is subjected to bending vibration in a mode in which the vibration is on the zeroth order in the x-axis direction, and on the third order in the z-axis direction. The displacement profile in this bending vibration mode is shown in FIG. 3, in which A—A', B—B' and C—C' represent the three antinode positions. Between the adjacent antinodes, there are two nodes, one between the antinodes A—A' and B—B', and the other between the antinodes B—B' and C—C'. Since the row 12 of the apertures 11 is substantially aligned with the antinode B—B' where the vibration acceleration is maximum, the toner particles T will not adhere to the portions of the electrode member 1 which are adjacent to the openings of the apertures 11, whereby the plugging of the apertures 11 with the particles T can be effectively avoided by the bending vibration caused by the displacement of the piezoelectric elements 2.

Figure 4:
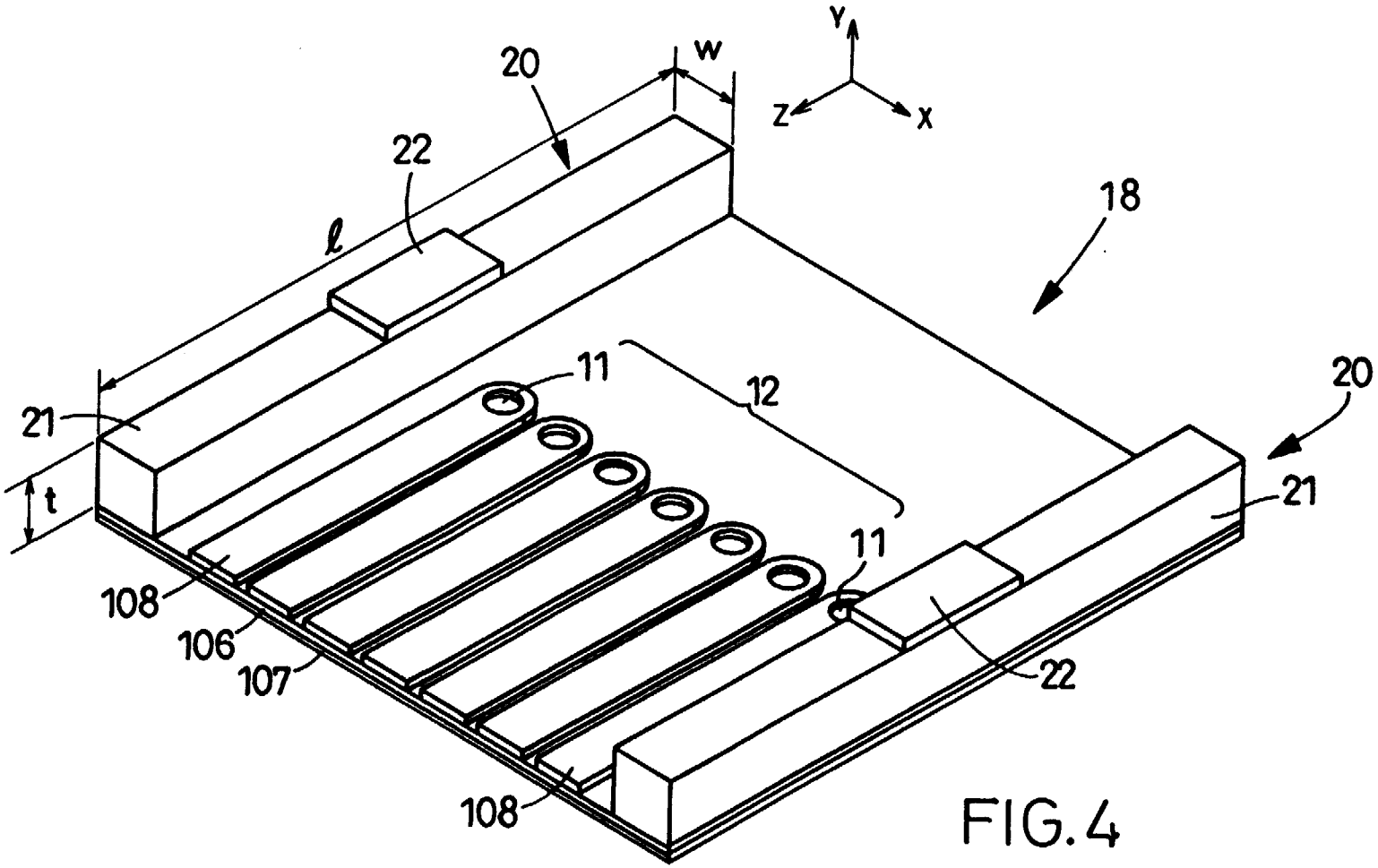
FIG. 4 is a perspective view corresponding to that of FIG. 2, showing a particle-flow modulating electrode member used in another embodiment of the present invention.
Figure 5:
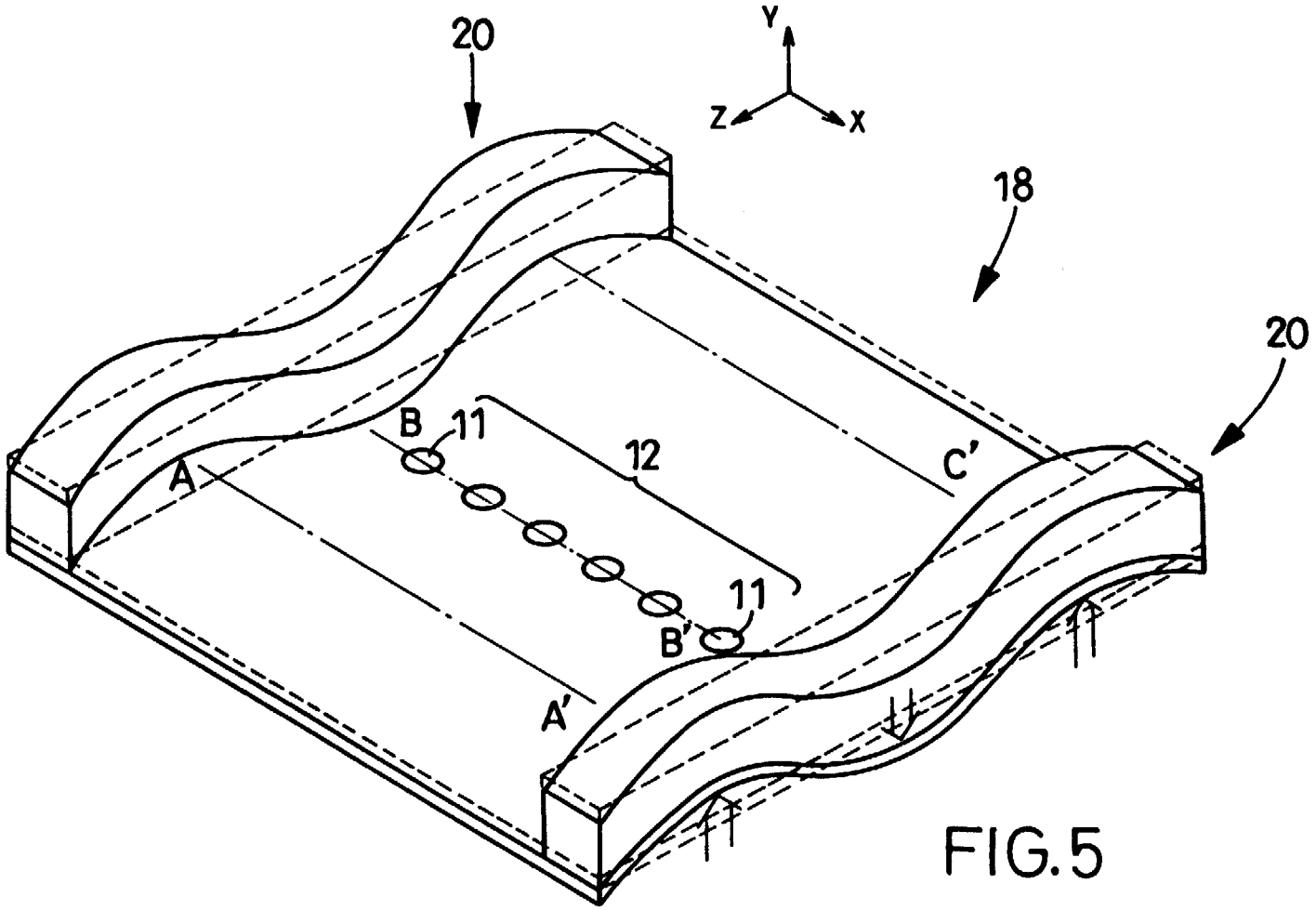
FIG. 5 is a view corresponding to that of FIG. 3, showing a bending vibration mode of the electrode member of FIG. 4.

Referring next to FIGS. 4 and 5, there will be described another embodiment of the present invention, which uses a modified particle-flow modulating electrode member 18. This second embodiment is identical with the first embodiment, except for this electrode member 18.

The electrode member 18 is also a generally plate-like member having a rectangular shape. On this electrode member 18, there is provided an oscillating device 20 which includes a pair of elongate rectangular elastic bodies 21, and a pair of piezoelectric elements 22 as an oscillator provided on the respective elastic bodies 21. The elastic bodies 21 extend in the z-axis direction and are disposed on the insulating layer 106, along the opposite edges of the electrode member 18. Each elastic body 20 has a length l, a width W and a thickness t as indicated in FIG. 4. The piezoelectric elements 22 function to cause bending vibration of the elastic bodies 21, and consequently bending vibration of the electrode member 18, as indicated in FIG. 5. As in the first embodiment, the elements 22 are connected to a suitable driver circuit. The vibration of the elastic bodies 21 as indicated in FIG. 5 is considered to be vibration of an oscillator whose opposite ends are free. The resonance frequency fr of this oscillator is represented by the following equation:

$$fr=(\pi\lambda t/2L^2)\times[\{E/12(1-\nu^2)\rho\}]^{1}$$

where

E: Young's modulus of the elastic bodies $\rho$: density of the elastic bodies $\nu$: Poisson's ratio of the elastic bodies $\lambda$: constant determined by the order of the vibration mode In the example of the bending vibration as shown in FIG. 5, $\lambda$ is equal to 3.5. The thickness t of the elastic bodies 21 and the thickness t' of the electrode member 18 are determined to satisfy $t>>t'$, that is, so that the thickness t of the elastic bodies 21 is much larger than the thickness t' of the electrode member 18, for example, $t>10t'$, in order to assure that the resonance frequency of the electrode member 18 is substantially equal to the resonance frequency fr of the elastic bodies 21. Where the elastic bodies 21 are made of duralumin whose Young's modulus E, density $\rho$ and Poisson's ratio $\nu$ are as indicated below, the resonance frequency fr of the elastic bodies 21 is calculated as follows:

$$fr=2.396\times10^3\times\lambda t/L^2$$

where $E=6.85\times10^{10}[N/m^2]$ $\rho=2695$ [kg/m$^3$]

$\nu=0.3$

The thickness t (t>>t') and length of the elastic bodies 21 are selected so that the resonance frequency fr calculated according to the above equation is not lower than about 20 kHz, namely, the bending vibration of the elastic bodies 21 is in the form of ultrasonic vibration.

In order that the resonance frequency fr of the elastic bodies 21 is about 30 kHz, for example, the elastic bodies 21 are dimensioned as follows:

l=50 mm w=10 mm t=9 mm

In the present second embodiment, too, the charged particles T will not adhere to the portions of the electrode member 18 adjacent to the openings of the apertures 11, since the aperture row 12 is substantially aligned with the antinode B—B' of the vibration caused by the oscillating device 20, as indicated in FIG. 5. This embodiment is also effective to prevent the plugging of the apertures 11 with the charged particles T.

While the specific bending vibration modes of the particle-flow modulating electrode members 1 and 18 produced by the oscillating devices 2, 20 have been described by reference to FIGS. 3 and 5, the oscillating device used according to the principle of the present invention may be adapted to produce other vibration modes as long as an antinode of the vibration is aligned with or located near the row 12 of the apertures 11 of the electrode member 1, 18.

In the illustrated embodiments, the oscillating device uses the piezoelectric elements 2, 22. However, other elements such as electrostrictive or magnetostrictive elements for converting an electric energy into a mechanical energy may be utilized for the oscillating device for vibrating the electrode member.

Although the oscillating device 20 of the second embodiment uses duralumin for the elastic bodies 21, the elastic bodies may be formed of other suitable material, such as brass, stainless steel or other metal, and a ceramic other non-metallic material. Further, the dimensions and the resonance frequency of the elastic bodies 21 are not limited to the details specified with respect to the second embodiment, but may be suitably determined to meet the particular requirement.

It is to be understood that the present invention may be embodied with various other changes, modifications and improvements, which may occur to those skilled in the art, without departing from the spirit and scope of the invention defined in the following claims.

What is claimed is:

1. A toner jet recording apparatus, comprising:

a toner supply for providing a crowd of electrostatically charged toner particles;

a particle-flow modulating electrode member including an aperture portion which has a multiplicity of apertures;

a back electrode disposed in opposed relation with a surface of said modulating electrode member which is remote from said toner supply, said back electrode supporting a recording medium which is interposed between said back electrode and said modulating electrode member;

a control circuit for applying controlled electric signals to said modulating electrode member and said back electrode, for causing flows of said charged particles through selected ones of said apertures toward said back electrode; and an oscillating device for vibrating said modulating electrode member, in a vibration mode wherein a vibration of said modulating electrode member produced by said oscillating device has an antinode which is substantially aligned with said aperture portion of said modulating electrode member.

2. A toner jet recording apparatus according to claim 1, wherein said oscillating device applies ultrasonic vibration to said modulating electrode member.

3. A toner jet recording apparatus according to claim 1, wherein said oscillating device includes an elastic member, and an oscillator for applying ultrasonic vibration to said elastic member.

4. A toner jet recording apparatus according to claim 3, wherein said elastic member is formed of a metallic material.

5. A toner jet recording apparatus according to claim 4, wherein said metallic material consists essentially of duralumin.

6. A toner jet recording apparatus according to claim 3, wherein said elastic member is formed of a ceramic material.

7. A toner jet recording apparatus according to claim 3, wherein said elastic member has a thickness which is more than ten times that of said modulating electrode member.

8. A toner jet recording apparatus, comprising:

a toner supply for providing a crowd of electrostatically charged toner particles;

a generally plate-like particle-flow modulating electrode member having a rectangular shape and including an aperture portion which has a multiplicity of apertures, said aperture portion extending parallel to one of four sides of said modulating electrode member so that said multiplicity of apertures are formed in a straight row parallel to said one of said four sides;

a back electrode disposed in opposed relation with a surface of said modulating electrode member which is remote from said toner supply, said back electrode supporting a recording medium which is interposed between said back electrode and said modulating electrode member;

a control circuit for applying controlled electric signals to said modulating electrode member and said back electrode, for causing flows of said charged particles through selected ones of said apertures toward said back electrode; and an oscillating device for vibrating said modulating electrode member, in a vibration mode wherein a vibration of said modulating electrode member has an antinode substantially aligned with said straight row of said apertures, said oscillating device including a pair of elongate rectangular elastic bodies fixed on said modulating electrode member, and an oscillator for applying ultrasonic vibration to said elastic bodies to thereby vibrate said modulating electrode member, said elastic bodies extending parallel to respective two sides of said modulating electrode member which is perpendicular to said one of said four sides.

9. A toner jet recording apparatus according to claim 8, wherein said oscillator includes a pair of oscillating elements which are fixed to said pair of elongate rectangular elastic bodies, respectively and which oscillate upon application of an electric energy thereto.

10. A toner jet recording apparatus according to claim 9, wherein each of said pair of oscillating elements is fixed to one of an opposite surface of a corresponding elongate rectangular elastic body which is remote from a surface of said modulating electrode member to which said modulating electrode member is fixed.

11. A toner jet recording apparatus according to claim 9, wherein said pair of oscillating elements consists of a pair of piezoelectric elements.

12. A toner jet recording apparatus according to claim 8, wherein said straight row of said apertures is intermediate said one side of said plate-like member and another side opposite to said one side, said vibration mode having three antinodes consisting of said antinode aligned with said straight row of said apertures, and two antinodes on both sides of said straight row, and two nodes between adjacent ones of said three antinodes.

* * * * *